US007852000B2

(12) United States Patent
Hsu et al.

(10) Patent No.: US 7,852,000 B2
(45) Date of Patent: Dec. 14, 2010

(54) FLAT FLUORESCENT LAMP AND STRUCTURE OF THE SAME

(75) Inventors: Horng-Bin Hsu, Taipei (TW); Yuan-Ker Lan, Hsinchu (TW); Hung-Ru Hsu, Chang Hua Hsien (TW)

(73) Assignee: AU Optronics Corp., Hsinchu (TW)

( * ) Notice: Subject to any disclaimer, the term of this patent is extended or adjusted under 35 U.S.C. 154(b) by 469 days.

(21) Appl. No.: 11/490,083

(22) Filed: Jul. 21, 2006

(65) Prior Publication Data

US 2007/0145877 A1 Jun. 28, 2007

(30) Foreign Application Priority Data

Dec. 23, 2005 (TW) ..... 94146204 A
Apr. 14, 2006 (TW) ..... 95113434 A

(51) Int. Cl.
*H01J 17/49* (2006.01)

(52) U.S. Cl. ..... 313/582

(58) Field of Classification Search ..... 313/484, 313/582–587, 113
See application file for complete search history.

(56) References Cited

U.S. PATENT DOCUMENTS 5,479,071 A * 12/1995 Lynn ..... 313/514
6,771,330 B2 8/2004 Moon
2001/0004250 A1* 6/2001 Kado et al. ..... 345/60
2004/0189171 A1* 9/2004 Bettinelli et al. ..... 313/292
2006/0055296 A1* 3/2006 Park et al. ..... 313/116

FOREIGN PATENT DOCUMENTS

TW 594830 A 4/1992

* cited by examiner

*Primary Examiner*—Joseph L Williams
*Assistant Examiner*—Hana S Featherly
(74) *Attorney, Agent, or Firm*—Birch, Stewart, Kolasch & Birch, LLP

(57) ABSTRACT

A flat fluorescent lamp structure comprising a first substrate, a second substrate, a wall structure, a phosphor layer, and a discharge gas is provided in the present invention. The second substrate is oppositely assembled to the first substrate to form a sealed space. The wall structure is utilized to separate the sealed space into a plurality of illuminating chambers. A tunnel penetrates the wall structure to communicate the illuminating chambers. In addition, the tunnel divides the adjacent illuminating chamber into a first illuminating sub-chamber and a second illuminating sub-chamber connecting with each other. The phosphor layer is formed on inner surfaces of the illuminating chambers. The discharge gas is filled in the illuminating chambers. A ratio of a length and a cross-section area of the tunnel defines a first coefficient, a ratio of a length and a cross-section area of the first illuminating sub-chamber defines a second coefficient, a ratio of a length and a cross-section area of the second illuminating sub-chamber defines a third coefficient, and a ratio of the first coefficient and the second coefficient or the third coefficient is greater than 1/20.

17 Claims, 6 Drawing Sheets

FLAT FLUORESCENT LAMP AND STRUCTURE OF THE SAME

This application claims the benefit of Taiwan Patent applications Serial No. 94146204, filed Dec. 23, 2005 and Serial No. 95113434, filed Apr. 14, 2006.

BACKGROUND OF THE INVENTION (1) Field of the Invention

This invention relates to a flat fluorescent lamp structure, and more particularly relates to a flat fluorescent lamp structure applied as a backlight source of a display.

(2) Description of the Related art

The cold cathode fluorescent lamp (CCFL) is a common illumination device widely applied in backlight modules of liquid crystal displays. The CCFL illuminates by using plasma, which is generated by the electrons ejected from the cathode colliding with discharge gas to ionize and excite the discharge gas atom. Then, the excited atoms in the plasma release energy by the way of radiating ultra-violet (UV) illumination to back to the ground state. The UV illumination is absorbed by the phosphor layer painted on the wall of the CCFL to generate visible light.

As the size of LCD increases, the backlight module thereof needs a bigger illumination surface with better brightness and uniformity. When the CCFL is applied in small size LCD, the CCFL provides illumination from an edge of a light guide to generate a planar light source. However, when the CCFL is applied in large size LCD, a direct type backlight module, which skips the light guide and applies a plurality of CCFLs to illuminate the LCD directly instead, is commonly used.

Flat fluorescent lamp is another light source applied in backlight module. The flat fluorescent lamp illuminates based on the theory similar to the above mentioned CCFL but with a different structure. It is noted that a planar light source, especially the one with uniform brightness, is demanded for the illumination of LCD. The direct type backlight module, which is composed of a plurality of CCFLs, has a restriction in illuminating uniformity due to the brightness difference of the gap between neighboring CCFLs and the CCFL itself. In addition, the direct type backlight module also needs higher cost and complicate assembling process. Thus, the flat fluorescent lamp is presented as a direct planar light source to meet the need of LCD.

FIG. 1A shows a top view of a typical flat fluorescent lamp, FIG. 1B shows a cross-section view of the flat fluorescent lamp along b-b cross-section. Referring to FIG. 1B, the flat fluorescent lamp structure 10 has a first substrate 12 and a second substrate 14 forming a sealed space (unlabeled) filled with discharge gas 18. Inside the flat fluorescent lamp structure 10, the opposite surfaces of the first substrate 12 and the second substrate 14 respectively are painted or coated with phosphor layer 16. Also referring to FIG. 1A, the flat fluorescent lamp 1 has electrodes 11 formed on the opposite edges of the flat fluorescent lamp structure 10 to generate current. As the current is generated, the flat fluorescent lamp illuminates by the way the above mentioned CCFL does.

Also referring to FIG. 1C, which is a cross-section view along c-c cross-section of FIG. 1A, a plurality of wall structure 13 is assembled between the first substrate 12 and the second substrate 14 to form a plurality of illuminating chambers 15. The illuminating chambers 15 are structurally similar to a plurality of CCFLs arranged side by side.

It is noted that the process of fabricating the flat fluorescent lamp structure 10 usually has the first substrate 12, the wall structure 13, and the second substrate 14 assembled as a whole before vacuuming the illuminating chambers 15 and injecting discharge gas 18. In order to facilitate the vacuuming and the injecting processes, some tunnels 17 are formed through the wall structure 13 between illuminating chambers 15 to have all the illuminating chambers 15 communicating with each other.

However, the existing of tunnels 17 may hinder the lighting of illuminating chambers 15. Also referring to FIG. 1D, which shows an equivalent circuit diagram of the flat fluorescent lamp of FIG. 1A. The discharge gas 18 within the illuminating chambers 15 of FIG. 1A may be regarded as resistors R1, R3, R5, R7, and R9 of FIG. 1D respectively when discharging. For the same reason, the discharge gas 18 within the tunnels 17 of FIG. 1A may be regarded as resistors R2, R4, R6, and R8 of FIG. 1D respectively. The demanded current is provided by a current providing circuit, for example, power supply circuit 22.

It is understood that resistance is proportional to the ratio of length and cross-section area. The content mentioned below is based on the theory.

Ordinarily, the wall structure 13 of FIG. 1C is formed on the first substrate 12 by using thermal forming or sand blasting technology. The tunnels 17 with a cross-section area substantially close to the cross-section area of the illuminating chambers 15 are usually preserved at the same time. Since the length of the tunnel 17 is smaller than the length of the illuminating chamber 15. The resistance of the resistors R2, R4, R6, and R8 with respect to the tunnels 17 is much smaller than the resistance of the resistors R1, R3, R5, R7, and R9 with respect to the illuminating chambers 15.

On the other hand, the fabrication process in reality may result in variation of individual illuminating chambers 15. That is, the resistance of the resistors R1, R3, R5, R7, and R9 may not be the same. Thus, the non-uniformity of current distributed within the flat fluorescent lamp 1 seems unpreventable. When the non-uniformity of current becomes serious, even some illuminating chambers cannot be lighted to result in non-uniformity of lighting. Take the resistor R1, R2, and R3 of FIG. 1D for example. As the resistance of resistor R3 is small than the resistor R1 in reality, and the resistance of serially connected resistors R3 and R2 is smaller than that of the resistor R1 (R3+R2>R1), part of the current predicted to flow through the illuminating chamber 15 with respect to the resistor R1 flows through the tunnel 17 with respect to the resistor R2 and the illuminating chamber 15 with respect to the resistor R3. Thus, the illuminating chamber 15 with respect to resistor R1 may not be lighted so as to result in a failure flat fluorescent lamp attending with the increasing of cost.

Accordingly, in regard of the existing drawback as mentioned above, how to promote the drawback by effectively improving the non-uniformity of lighting of the flat fluorescent lamp has become an object in the present LCD industry.

SUMMARY OF THE INVENTION

It is an object of the present invention to provide a flat fluorescent lamp structure and a flat fluorescent lamp capable of improving non-uniformity of lighting.

It is another object of the present invention to provide a flat fluorescent lamp structure and a flat fluorescent lamp capable of enhancing reliability of current characteristics.

It is another object of the present invention to provide a flat fluorescent lamp structure and a flat fluorescent lamp which can be uniformly lighted without the need of adding any additional vacuuming or discharge gas injecting process.

A flat fluorescent lamp structure comprising a first substrate, a second substrate, a wall structure, a phosphor layer, and a discharge gas is provided in the present invention. The second substrate is oppositely assembled to the first substrate to form a sealed space. The wall structure is utilized to separate the sealed space into a plurality of illuminating chambers. A tunnel penetrates the wall structure to communicate the illuminating chambers. In addition, the tunnel divides the adjacent illuminating chamber into a first illuminating sub-chamber and a second illuminating sub-chamber connecting with each other. The phosphor layer is formed on inner surfaces of the illuminating chambers. The discharge gas is filled in the illuminating chambers. A ratio of a length and a cross-section area of the tunnel defines a first coefficient, a ratio of a length and a cross-section area of the first illuminating sub-chamber defines a second coefficient, and a ratio of a length and a cross-section area of the second illuminating sub-chamber defines a third coefficient, a ratio of the first coefficient and the second coefficient is greater than 1/20, and a ratio of the first coefficient and the third coefficient is greater than 1/20.

A flat fluorescent lamp comprising a first substrate, a second substrate, at least an electrode, a phosphor layer, and a discharge gas is also provided in the present invention. The second substrate is oppositely assembled to the first substrate to form a plurality of illuminating chambers and at least a tunnel, wherein the tunnel is communicated with the neighboring illuminating chambers and a cross-section area of the tunnel is smaller than that of the illuminating chamber. The electrode is connected to the illuminating chambers. The phosphor layer is formed on inner surfaces of the illuminating chambers. The discharge gas is filled in the illuminating chambers. In addition, a ratio of a length and a cross-section area of the tunnel defines a first coefficient, a ratio of a length and a cross-section area of the first illuminating sub-chamber defines a second coefficient, and a ratio of a length and a cross-section area of the second illuminating sub-chamber defines a third coefficient, the first coefficient may be greater than the second coefficient or the third coefficient. Moreover, a ratio of the first coefficient and the second coefficient and of the first coefficient and the third coefficient is greater than 1/20 or greater than 20.

It is noted that the resistance with respect to the tunnel is much greater than the resistance with respect to the illuminating chamber in accordance with the present invention. Thus, the current provided by the electrodes would not flow into the high-resistance tunnel to make sure the flat fluorescent lamp can be uniformly lighted.

BRIEF DESCRIPTION OF THE DRAWINGS

The present invention will now be specified with reference to its preferred embodiment illustrated in the drawings, in which.

DESCRIPTION OF THE PREFERRED EMBODIMENTS

Figure 1A:
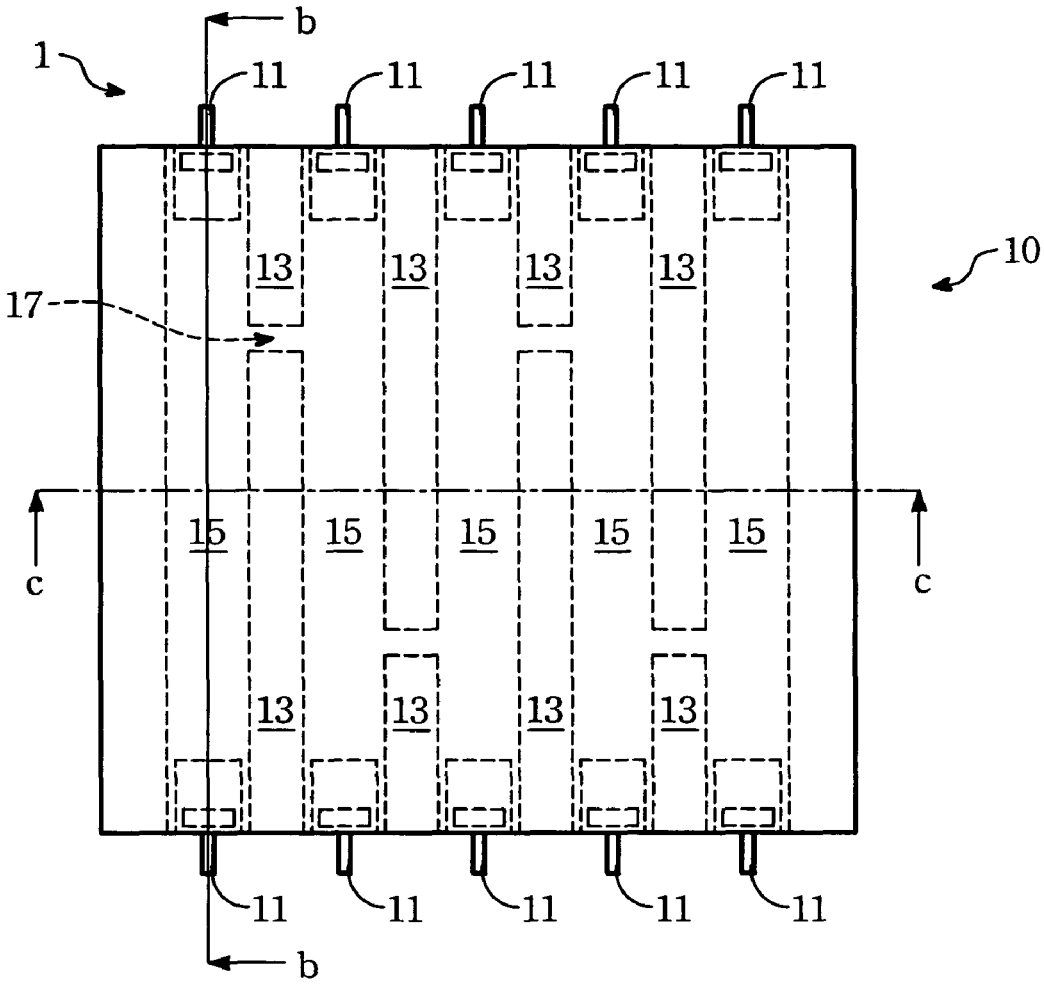
FIG. 1A (Prior Art)
FIG. 1A is a top view of a typical flat fluorescent lamp.
Figure 1B:
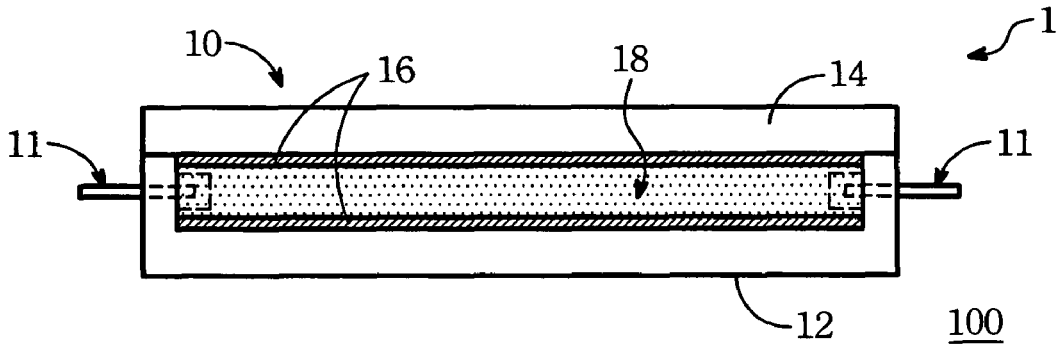
FIG. 1B (Prior Art)
FIG. 1B is a cross-section view along b-b cross-section of the flat fluorescent lamp of FIG. 1A.
Figure 1C:
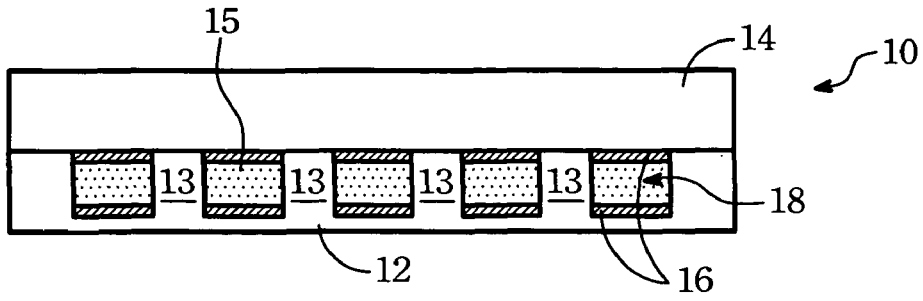
FIG. 1C (Prior Art)
FIG. 1C is a cross-section view along c-c cross-section of the flat fluorescent lamp of FIG. 1A.
Figure 1D:
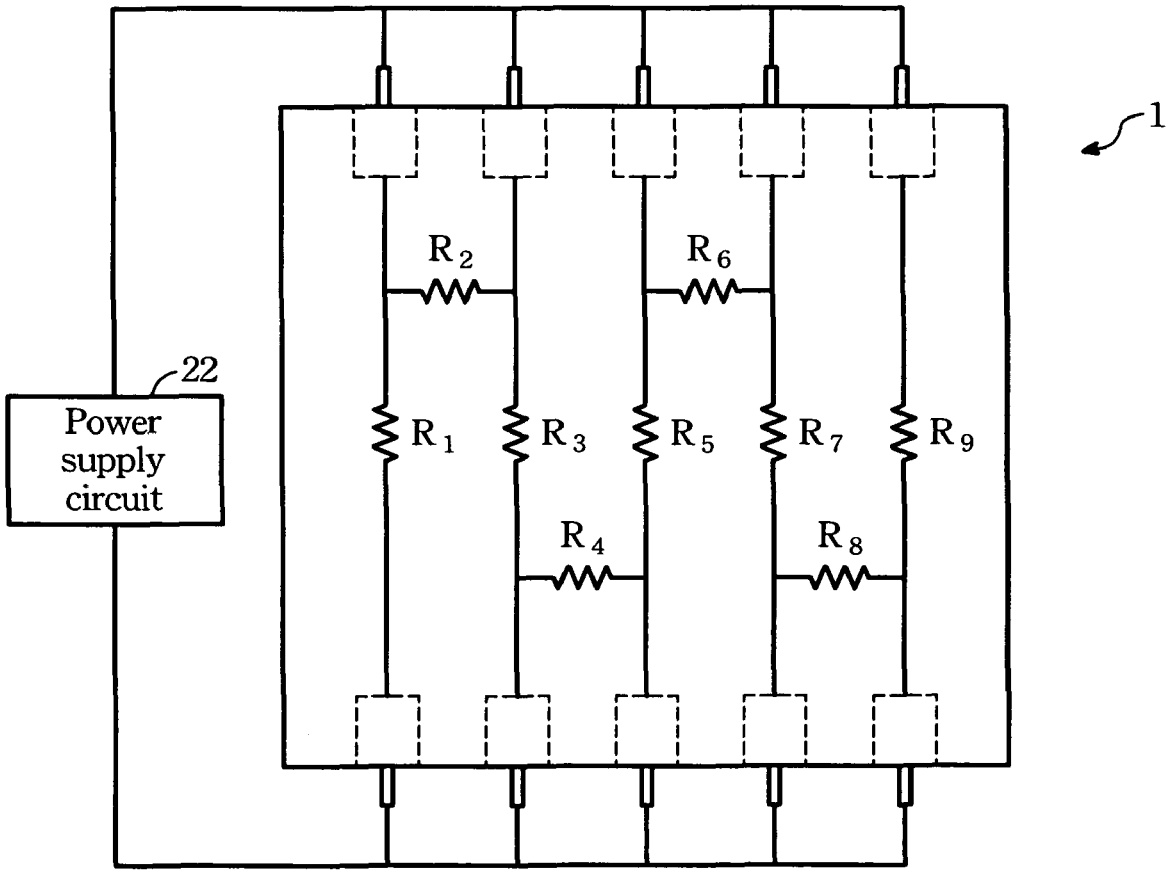
FIG. 1D (Prior Art)
FIG. 1D is a equivalent circuit diagram of the flat fluorescent lamp of FIG. 1A.
Figure 2A:
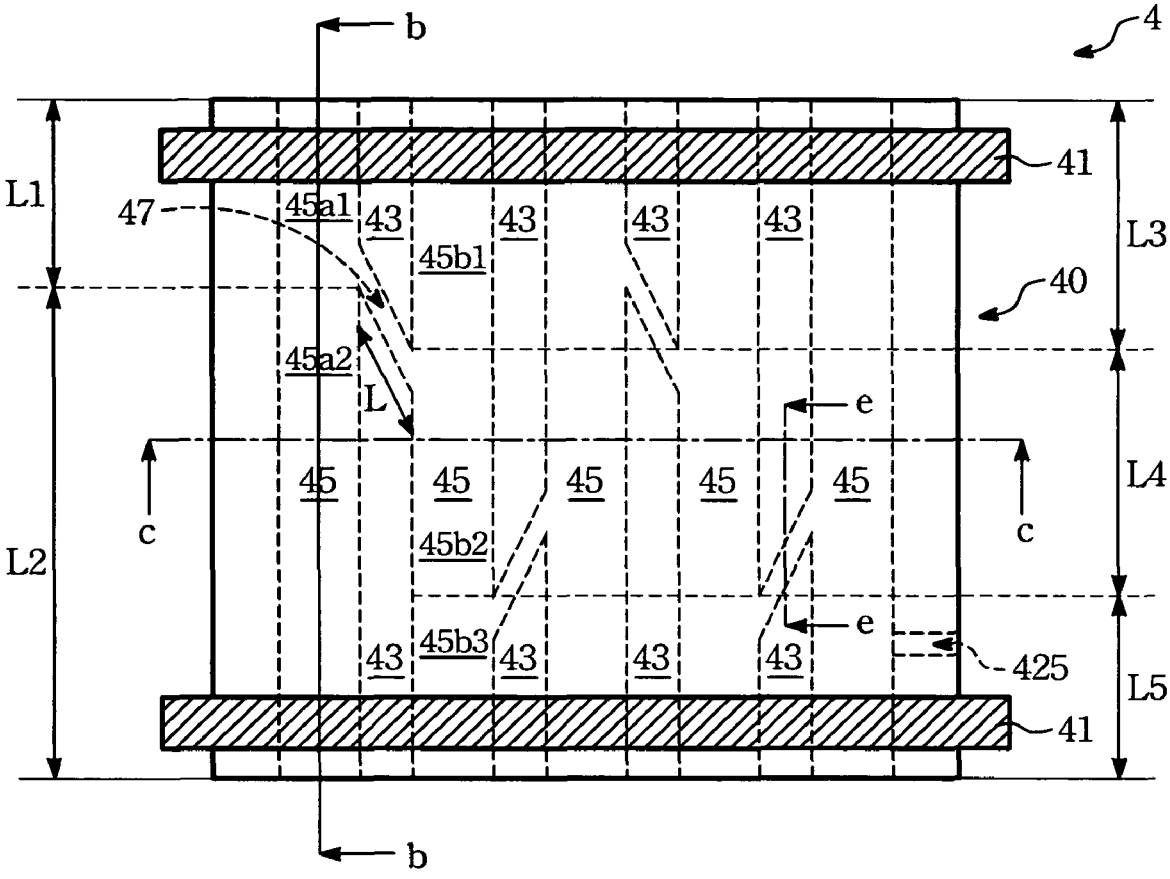
FIG. 2A is a top view of a flat fluorescent lamp in accordance with the present invention.

FIG. 2A shows a top view of a flat fluorescent lamp in accordance with the present invention, and FIG. 1B shows a cross-section view along b-b cross-section of the flat fluorescent lamp. As shown, the flat fluorescent lamp structure 40 has a first substrate 42, a wall structure 43, a second substrate 44, a phosphor layer 46, a tunnel 47, and a discharge gas 48. The flat fluorescent lamp 4 has electrodes 41 formed on the opposite edges of the flat fluorescent lamp structure 40 to generate current. The discharge gas 48 may be inert gas selected from the group consisting of Xe, Ne, Ar, and combinations thereof.

Figure 2B:
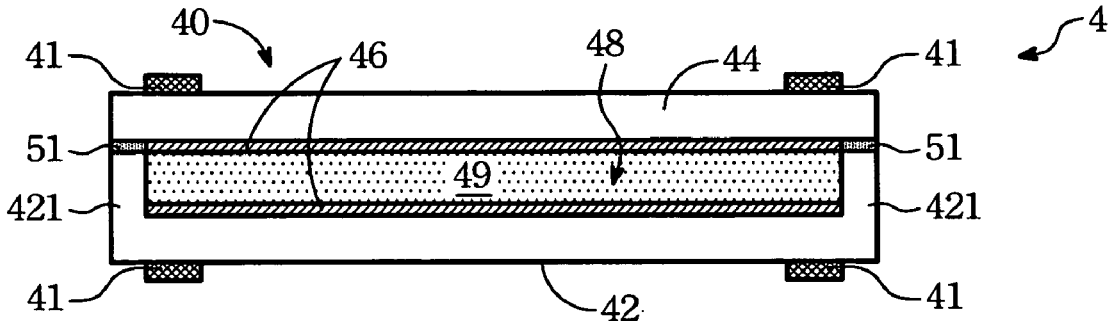
FIG. 2B is a cross-section view of the flat fluorescent lamp of FIG. 2A.

As shown in FIG. 2B, the second substrate 44 is oppositely assembled to the first substrate 42 to form a sealed box and also a sealed space 49. Within the seal space 49, the phosphor layer 46 is formed on the inner surfaces of the first substrate 42 and the second substrate 44. A sidewall 421 is formed surrounding the space between the first substrate 42 and the second substrate 44, and it may formed on an upper surface of the first substrate 42 as a preferred embodiment. When oppositely assembling the first substrate 42 and the second substrate 44, a sealant 51 may be placed on the top of the sidewall 421 to provide reliable connecting and sealing quality.

Figure 2C:
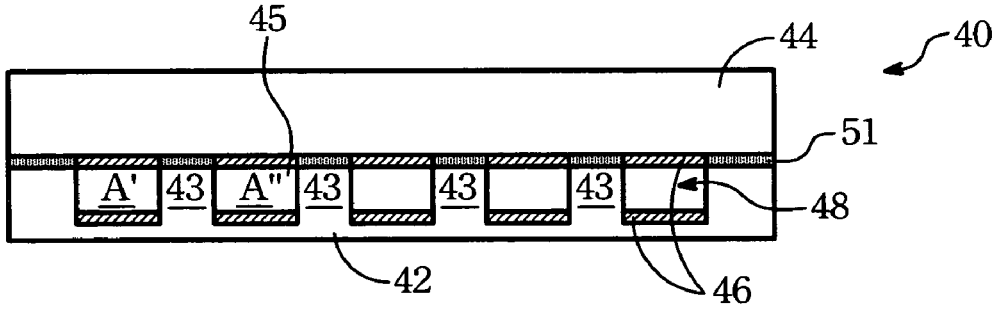
FIG. 2C is a cross-section view along c-c cross-section of a preferred embodiment of the flat fluorescent lamp of FIG. 2A.
Figure 2D:
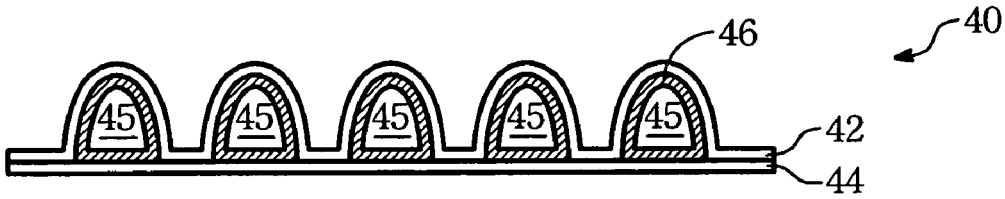
FIG. 2D is a cross-section view along c-c cross-section of another preferred embodiment of the flat fluorescent lamp of FIG. 2A.

The structure or assembling procedure of the first substrate 42, wall structure 43, and the second substrate 44 has many varieties. For example, a plurality of concaves may be directly formed on the first substrate 42, which is understood as forming the wall structure 43 on the first substrate 42 integrally. In addition, the flat fluorescent lamp structure 40 of FIG. 2D features a specific designed first substrate 42 to replace the usage of wall structure 43 as shown in FIG. 2C, but the proposed function and object of the two cases are identical. Therefore, it is noted that the wall structure 43, the first substrate 42, and the second substrate 44 may not definitely be separated parts. The wall 43, the first substrate 42, and the second substrate 44 may be formed into one piece, or the wall 43 and the first substrate 42 may be formed into one piece. The naming for these elements is for clarifying individual function but not for restricting the present invention.

The first substrate 42, the second substrate 44, and the sidewall 421 are formed of a material comprising glass. As a preferred embodiment of the present invention, the second substrate 44, which is selected as an illuminating surface of the flat fluorescent lamp structure 40, is formed of a transparent material. In addition, the first substrate 42 may be painted with reflecting material or assembled with a reflector to increase illumination efficiency.

Referring to FIG. 2C, which shows a cross-section view of the flat fluorescent lamp of FIG. 2A along c-c cross-section, the wall structure 43 divides the sealed space 49 into a plurality of illuminating chambers 45. Also referring to FIG. 2A, the tunnels 47 penetrates through the wall structure 43 to communicate the illuminating chambers 45. By using the preset opening 425 on the sidewall 421, the seal space 49 as a whole can be vacuumed. Then, the discharge gas 48 is filled into the illuminating chambers 45 through the opening 425, and following the opening 425 is sealed to finish the fabrication process.

As shown in FIG. 2C, the phosphor layer 46 may be formed on the inner surfaces of the illuminating chambers 45. That is, besides the formation of phosphor layer 46 on the first substrate 42 and the second substrate 44, the phosphor layer 46 may be also formed on the surface of the wall structure 43. In addition, in the embodiment as shown in FIG. 2C, the wall structure 43, which is formed of a material identical to that of the first substrate 42, is formed on the first substrate 42 before assembling to the second substrate 44. As the first substrate 42 is assembled to the second substrate 44, the sealant 51 is placed on the top of the wall structure 43 to connect the second substrate 44 and the wall structure 43. The discharge gas 48 may be an inert gas selected from Xe, Ne, or Ar.

Also referring to FIG. 2B in views of FIG. 2A, the demanded current in the flat fluorescent lamp structure 40 is provided by outside electrodes 41, which are connected to the illuminating chambers 45. As shown in FIG. 2B, the outside electrodes 41 are assembled on the outer surface of the first substrate 42 or the second substrate 44 and discharge through the two substrates 42 and 44. Thus, the glass material of the first substrate 42 or the second substrate 44 may be regarded as a capacitor. In addition, the power supply circuit 52 provides the demanded current as shown in the equivalent circuit diagram of FIG. 2E.

Figure 2E:
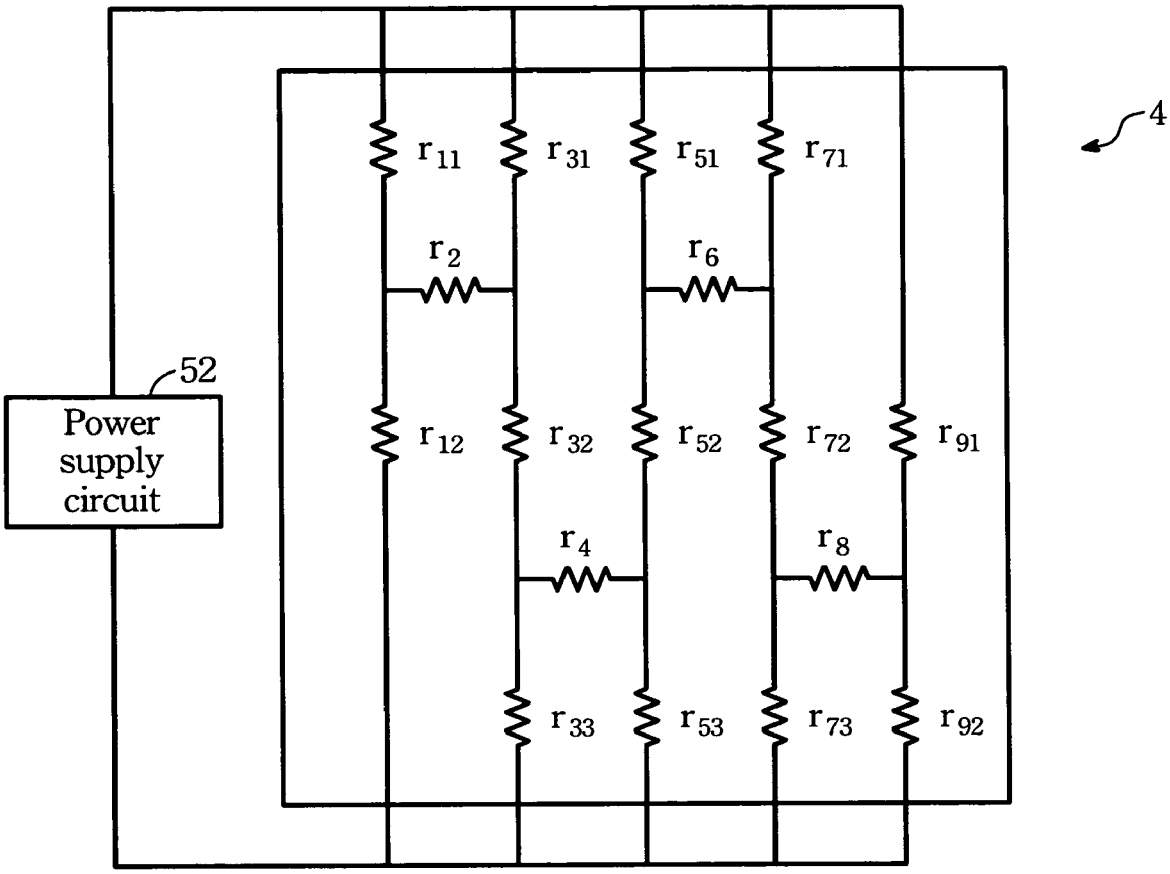
FIG. 2E is a equivalent circuit diagram of the flat fluorescent lamp of FIG. 2A.

In addition, also referring to FIG. 2A, the illuminating chamber 45 at the left end is divided by the adjacent tunnel 47 into a first illuminating sub-chamber 45*a*1 and a second illuminating sub-chamber 45*a*2. The discharge gas 48 within the first illuminating sub-chamber 45*a*1 and the second illuminating sub-chamber 45*a*2 forms chamber resistance respectively when discharging. Therefore, as shown in FIG. 2E, the first illuminating sub-chamber 45*a*1 and the second illuminating sub-chamber 45*a*2 may be regarded as resistors r11 and r12, respectively. For the same reason, the adjacent tunnel 47 may be regarded as a resistor r2. In order to solve the problem of non-uniformity of lighting existed in the typical flat fluorescent lamp 1 as shown in FIGS. 1A to 1D, the idea provided in the present invention focuses on enormously increasing tunnel resistance corresponding to the resistor r2, to have the tunnel resistance greater than the chamber resistance corresponding to the resistors r11 and r12.

Figure 2F:
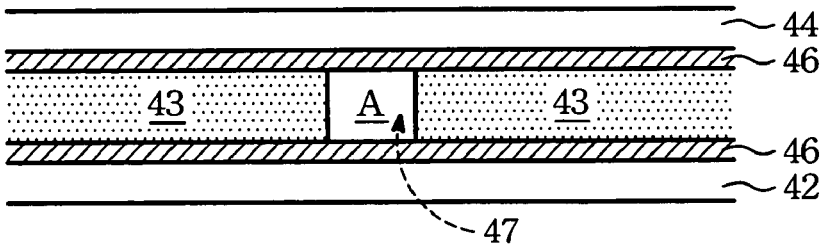
FIG. 2F is a cross-section view along e-e cross-section of a preferred embodiment of the flat fluorescent lamp of FIG. 2A.

According to the function about resistance $R=\rho\cdot L/A$, the resistance R of the tunnel 47 is proportional to the length L of the tunnel 47 as shown in FIG. 2A, but inversely proportional to the cross-section area A of the tunnel 47 as show in FIG. 2F, which shows a cross-section view along e-e cross-section. The equivalent coefficient of resistance ρ of the tunnel 47 is related to the ionization of gas within the tunnel 47. Let a ratio of the length L and the cross-section area A of the tunnel 47 defines a first coefficient, a ratio of the length L1 as shown in FIG. 2A and the cross-section area A' as shown in FIG. 2C of the first illuminating sub-chamber 45*a*1 defines as a second coefficient, and a ratio of the length L2 and the cross-section area A' of the second illuminating sub-chamber 45*a*2 defines a third coefficient. In order to have the flat fluorescent lamp uniformly lighted, the resistance of the tunnel should be greater than the resistance of the chamber. As s preferred embodiment, both a ratio of the first coefficient and the second coefficient and a ratio of the first coefficient and the third coefficient are greater than 1/20 to make sure individual illuminating chambers 45 are successfully lighted. In another preferred embodiment, both the ratio of the first coefficient and the second coefficient and the ratio of the first coefficient and the third coefficient are greater than 20.

In practice, the present invention achieves the limitations about the ratio of the first coefficient and the second coefficient or the third coefficient by elongating the length L of the tunnel or decreasing the cross-section area A of the tunnel. The detail of the adjusting method is mentioned below.

Except the above mentioned embodiment, the three illuminating chambers 45 located in the center of FIG. 2A depict another preferred embodiment. As shown, each of the illuminating chamber 45 located in the center is divided by two adjacent tunnels 47 located at the both sides into three illuminating sub-chambers. Take the second illuminating chamber 45 counted from the left for example. As shown, the illuminating chamber 45 is divided by the tunnels 47 into three illuminating sub-chambers 45*b*1, 45*b*2, and 45*b*3 corresponding to the resistors r31, r32, and r33 as shown in FIG. 2E. The two adjacent tunnels 47 are corresponding to the resistors r2 and r4. As mentioned in the above paragraph, the tunnel is corresponding to the defined first coefficient. A ratio of the length L3, L4, and L5 of the illuminating sub-chambers 45*b*1, 45*b*2, and 45*b*3 as shown in FIG. 2A and a cross-section area A" thereof as shown in FIG. 2C defines a fourth coefficient. The resistance of the tunnel corresponding to the resistors r2 and r4 should be greater than that of the chamber corresponding to the resistors r31, r32, and r33. As a preferred embodiment, a ratio of the first coefficient and the fourth coefficient is greater than 1/20 to make sure individual illuminating chambers 45 are successfully lighted. In another preferred embodiment, the ratio of the first coefficient and the fourth coefficient is greater than 20.

The embodiments for elongating the length L of the tunnel or decreasing the cross-section area A of the tunnel are described below in detail. In regarding of elongating the length L of the tunnel, as shown in FIG. 2A, without changing the thickness of the wall structure 43, this embodiment has the tunnel 47 penetrate through the wall structure 43 along a tilt direction to increase the length L of the tunnel. The varieties of the above mentioned method, such as adapting different tilt angle or having the tunnel 47 penetrating the wall structure 43 along different cross-section surfaces, are included in the present invention.

Figure 3A:
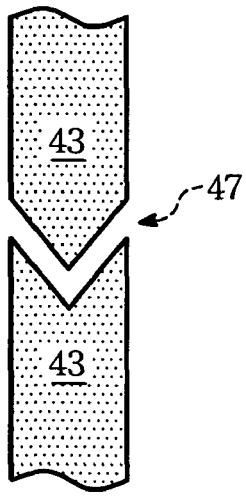
FIG. 3A is a top view of another preferred embodiment of the flat fluorescent lamp in accordance with the present invention.
Figure 3B:
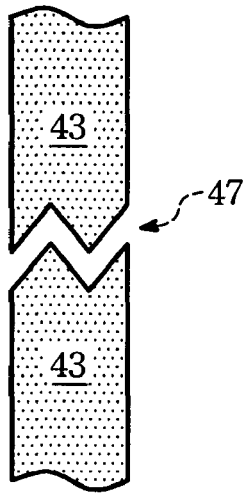
FIG. 3B is a top view of another preferred embodiment of the flat fluorescent lamp in accordance with the present invention.

FIG. 3A shows a top view of another preferred embodiment for elongating the length L of the tunnel. As shown, the tunnel 47 has a bend to increase the overall length L of the tunnel. FIG. 3B shows a top view of a similar embodiment, which uses two bends to form an N-type tunnel. It is understood that various embodiments using the same idea to increase the length of the tunnel 47 are available in accordance with the present invention.

Figure 4:
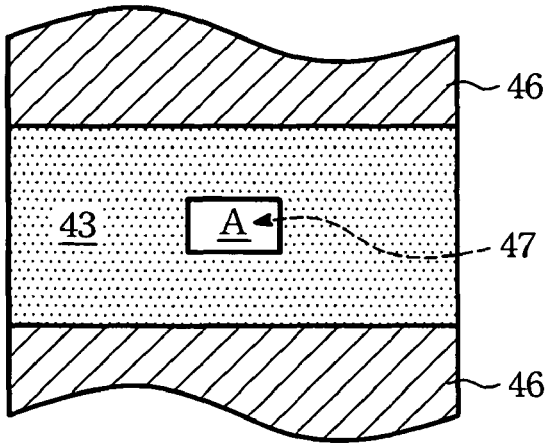
FIG. 4 is a cross-section view along e-e cross-section of another preferred embodiment of the flat fluorescent lamp of FIG. 2A.

The method of decreasing the cross-section area of the tunnel may be understood by comparing the flat fluorescent lamp structure of FIG. 2A and FIG. 1A. In the typical flat fluorescent lamp structure as shown in FIG. 1A, the width of the tunnel 17 is close to the width of the illuminating chamber 15, whereas, a narrower tunnel 47 is used in the present invention as shown in FIG. 2F to decrease cross-section area of the tunnel. Referring to another embodiment as shown in FIG. 4, which shows a cross-section view along e-e cross-section of FIG. 2A, the height h of the tunnel 47 is only part of the total height H of the wall structure 43 so as to decrease cross-section area of the tunnel.

As a result, the flat fluorescent lamp structure 40 provided in the present invention keeps the tunnel 47 to facilitate single vacuuming process and single discharge gas 48 filling process. In addition, since the equivalent resistance of individual chambers (r11, r12, r13, r31, r32, r33, r51, r52, r53, r71, r72, r73, r91, and r92 in FIG. 2E) and the equivalent resistance of tunnels (r2, r4, r6, and r8 in FIG. 2E) when applying current to the illuminating chamber 45 and the tunnel 47 are properly arranged in the present invention to have the resistance of tunnel greater than that of the chamber, the current predicted to flow through the illuminating chambers 45 would not make a detour along the tunnel 47 so as to make sure that all the illuminating chambers 45 are lighted. Therefore, the present invention not only facilitates the enhancement of fabrication yield of the flat fluorescent lamp but also prevents the abandon of products, which is good for saving cost. In addition, the present invention does not need additional process is particularly welcome to the industry.

While the embodiments of the present invention have been set forth for the purpose of disclosure, modifications of the disclosed embodiments of the present invention as well as other embodiments thereof may occur to those skilled in the art. Accordingly, the appended claims are intended to cover all embodiments which do not depart from the spirit and scope of the present invention.

What is claimed is:

1. A flat fluorescent lamp structure comprising:

a first substrate;

a second substrate assembled to the first substrate to form a sealed space;

at least one wall dividing the sealed space into:

a plurality of illuminating chambers filled with a discharge gas;

at least one tunnel formed therethrough to communicate the illuminating chambers, wherein the at least one tunnel divides the illuminating chamber into a first illuminating sub-chamber and a second illuminating sub-chamber; and a phosphor layer formed on a plurality of inner surfaces of the illuminating chambers;

wherein a ratio of a length to a cross-section area of the tunnel is a first coefficient, the ratio of the length to the cross-section area of the first illuminating sub-chamber is the second coefficient, and the ratio of the length to the cross-section area of the second illuminating sub-chamber is a third coefficient, wherein the ratio of the first coefficient to the second coefficient is greater than about 1/20, wherein the tunnel extends along a tilt direction relative to the illuminating chamber, and therebetween the entire tilt direction and the illuminating chamber form an acute angle, and wherein the entire tilt direction is formed by a first end of the tunnel directly connected with the illuminating chamber and a second end of the tunnel directly connected with another illuminating chamber adjacent to the illuminating chamber.

2. The flat fluorescent lamp structure of claim 1, wherein the ratio of the first coefficient to the third coefficient is greater than about 1/20.

3. The flat fluorescent lamp structure of claim 1, wherein the tunnel has at least one bend.

4. The flat fluorescent lamp structure of claim 1, wherein the cross-section area of the tunnel is smaller than that of the chamber.

5. The flat fluorescent lamp structure of claim 1, wherein the wall, the first substrate and the second substrate are formed into one piece.

6. The flat fluorescent lamp structure of claim 1, wherein the wall and the first substrate are formed into one piece.

7. The flat fluorescent lamp structure of claim 1, further comprising a sealant located between the wall and the second substrate.

8. The flat fluorescent lamp structure of claim 1, wherein the first substrate and the second substrate are comprised of glass.

9. The flat fluorescent lamp structure of claim 1, wherein the discharge gas comprises an inert gas.

10. The flat fluorescent lamp structure of claim 9, wherein the inert gas is selected from the group consisting of Xe, Ne, Ar, and combinations thereof.

11. The flat fluorescent lamp structure of claim 1, wherein the illuminating chamber is divided by a predetermined number of the tunnels into the predetermined number plus one illuminating sub-chambers.

12. The flat fluorescent lamp structure of claim 1, wherein the tunnels divide the illuminating chamber into the first illuminating sub-chamber, the second illuminating sub-chamber and a third illuminating sub-chamber, wherein the ratio of the length to the cross-section area of the third illuminating sub-chamber is a fourth coefficient, and the ratio of the first coefficient to the fourth coefficient is greater than about 1/20.

13. The flat fluorescent lamp structure of claim 12, wherein the tunnels extend along a tilt direction relative to the illuminating chamber.

14. The flat fluorescent lamp structure of claim 12, wherein the tunnels have at least one bend.

15. The flat fluorescent lamp structure of claim 12, wherein the cross-section areas of the tunnels is smaller than that of the illuminating chamber.

16. A flat fluorescent lamp comprising:

a first substrate;

a second substrate assembled to the first substrate to form:

a plurality of illuminating chambers filled with a discharge gas; and at least one tunnel, wherein the tunnel is communicated with the neighboring illuminating chambers, and a cross-section area of the tunnel is smaller than that of the illuminating chamber, wherein the tunnel extends along a tilt direction relative to the illuminating chamber, and therebetween the entire tilt direction and the illuminating chamber form an acute angle, and wherein the tilt direction is formed by a first end of the tunnel directly connected with the illuminating chamber and a second end of the tunnel directly connected with another illuminating chamber adjacent to the illuminating chamber, wherein the tunnel divides the illuminating chamber into a first illuminating sub-chamber and a second illumination sub-chamber, a ratio of a length to a cross-section of the tunnel is a first coefficient, the ratio of the length to the cross-section area of the first sub-illuminating chamber is a second coefficient, and the ratio of the length to the cross-section area of the second sub-illuminating chamber is a third coefficient, wherein the ratio of the first coefficient to the second coefficient is greater than about 1/20;

at least one electrode connected to the illuminating chambers; and a phosphor layer formed on a plurality of inner surfaces of the illuminating chambers.

17. The flat fluorescent lamp of claim 16, wherein the ratio of the first coefficient to the third coefficient is greater than about 1/20.

* * * * *